US006804845B2

(12) United States Patent
Stewart, III et al.

(10) Patent No.: US 6,804,845 B2
(45) Date of Patent: Oct. 19, 2004

(54) ADJUSTABLE BODY SUPPORT CUSHIONS

(75) Inventors: Kenneth G. Stewart, III, Sarasota, FL (US); Thomas Sweeney, Sarasota, FL (US)

(73) Assignee: The Ideal People LLC, Sarasota, FL (US)

( * ) Notice: Subject to any disclaimer, the term of this patent is extended or adjusted under 35 U.S.C. 154(b) by 508 days.

(21) Appl. No.: 10/024,191

(22) Filed: Dec. 21, 2001

(65) Prior Publication Data

US 2004/0123392 A1 Jul. 1, 2004

(51) Int. Cl.[7] ..... A47C 20/02
(52) U.S. Cl. ..... 5/632; 5/633; 5/652; 5/657
(58) Field of Search ..... 5/630, 632, 633, 5/636, 639, 640, 652, 657

(56) References Cited

U.S. PATENT DOCUMENTS 2,593,056 A 4/1952 Sage et al.
3,258,790 A * 7/1966 Maru ..... 5/636
3,913,155 A 10/1975 Eary, Sr.
3,938,205 A 2/1976 Spann
4,233,700 A 11/1980 Spann
4,802,249 A 2/1989 Bills
5,193,238 A 3/1993 Clute
5,216,772 A 6/1993 Clute
5,269,323 A 12/1993 Krouskop
5,272,780 A 12/1993 Clute
5,396,674 A 3/1995 Bolds
5,467,490 A * 11/1995 Rice ..... 5/636
6,009,873 A 1/2000 Neviaser

* cited by examiner

*Primary Examiner*—Teri Pham Luu
(74) *Attorney, Agent, or Firm*—Barnes & Thornburg, LLP

(57) ABSTRACT

An adjustable body support device for applying supportive pressure to spaced areas of the human body comprising two elongated resilient foam-like cushions adjustably joined for adjusting the spacing between them. The cushions may be provided with covers having pockets for holding hot or cold packs.

22 Claims, 3 Drawing Sheets

ADJUSTABLE BODY SUPPORT CUSHIONS

BACKGROUND OF THE INVENTION

1. Field of the Invention

The invention relates to a body support device which provides body supports for supportive pressure to desired areas of a person's torso in a manner which can also afford protection to a sensitive injured area of the torso.

More particularly, the invention relates to an adjustable support device which may be positioned like a prop pillow to provide support while resting. The device is adjustable to move the body supports relative to one another to accommodate persons of different size and to provide adjustable spacing between the supports to accommodate surgical dressings or to prevent pressure from being applied to a sensitive area.

2. Description of the Related Technology

U.S. Pat. No. 5,396,674 discloses an inclined body support with a peripheral padded frame having a pair of triangular end braces joined together by stays extending between corresponding corners of the braces and a padded tent suspended from the frame over one portion thereof. The device is for supporting the body of a user at an inclined orientation.

U.S. Pat. No. 5,216,772 discloses a support having two pillow sections, each section having an elongated resilient foam member covered with fabric. The sections are joined together with elongated hook and loop fastening strips which allow adjustable overlapping joinder of the two sections. The two joined support pillow sections together define an open-ended and open-top vertical walled channel with the sections and fabric covered foam members providing an anti-roll device for an infant. The joined sections do not provide for end to end spacing of the elongated sections.

U.S. Pat. No. 5,269,323 discloses a body support for supporting a human body lying on its side on a bed. The body support has two flexible arms extending outwardly with a head engaging structure connected to one of the arms and a leg engaging structure connected to the other arm for maintaining the body support against the body. The head engaging structure and leg engaging structure are substantially the same for reversibility. They are not adjustable to maintain a desired spacing between the cushion ends. The support may include a flat side, an inclined side and be right triangular in cross section.

SUMMARY OF THE INVENTION

The invention is directed to a supportive device for applying support to the front, back or side areas of a human torso. The device is useful for a body lying on a bed, sitting in a chair or for even resting on the ground.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
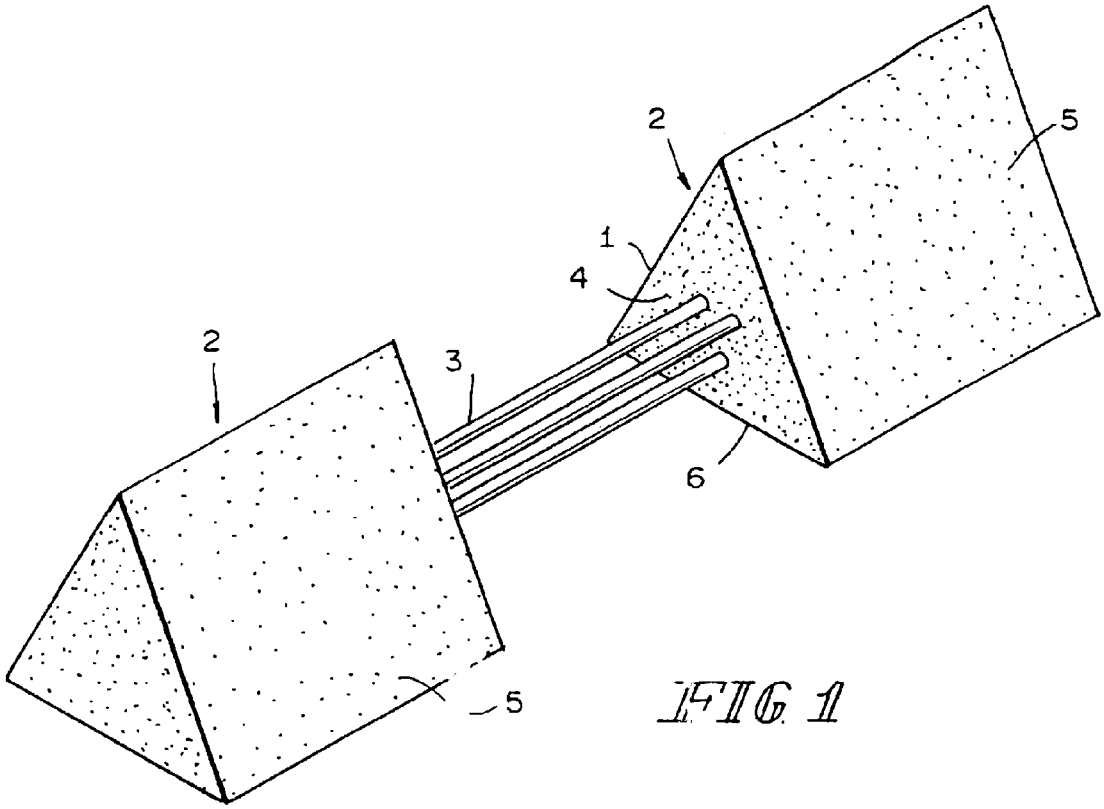
FIG. 1 shows a view of one embodiment according to the invention.

The preferred embodiment of the invention provides a device which may be used to provide support and comfort for a person while seated or lying down. The device is primarily for supporting the back at places from the waist to the shoulders. It has two or more support cushions which are easily adjustable to move the supports relative to each other to provide support at desired spaced areas of the torso. The adjustability of the device also enables persons of different size to be accommodated.

The support cushions depicted in the drawing are of similar size and shape, however, it should be evident that some variation in length, width and shape is contemplated without departing from the spirit and scope of the invention.

The device has an open area between the cushions which is designed to fit over a bandaged or healing area of the back. The open area also aids in permitting some beneficial air to contact the healing or injured area. Adjustability of the size of the open area is another aspect of the invention because it enables the user to move the support areas. This is useful to prevent muscle ache, bed sores, etc. It also makes the device flexible for use with different size people.

The device also may provide hot or cold pressure to assist in recovery from back surgery or to relieve back discomfort. It is useful to prevent body movement, especially while sleeping or at rest.

As seen in FIG. 1 the device comprises two cushions 2 connected by adjustable spacer tubes 3. Three tubes 3 are shown, however, one, two or more tubes are contemplated. The tubes 3 intersect the cushions 2 at locations proximate the central portion of each internal end face 4 of each cushion. It is preferred the tubes 3 do not intersect the end face of the cushions near the surface 5 since the closer the tubes 3 are to the surface 5 the more likely they will come in contact or be felt by the back of the person leaning against surface 5. Further, if the tubes 3 closely underlie the surface 5 an undesired surface rigidity would provide unacceptable discomfort at cushion surface 5. Only slight pressure from the tubes is desirable. For this reason it is preferred that connection to the end face of each cushion be in an area away from the edge of the cushion. In one embodiment (see FIG. 6) the tubes 3 are spaced sufficiently so that a person's hand can fit between the tubes 3 permitting bathing of a wound or replacement of a cold pack, etc. Alternatively, the tubes may closely abut the other surfaces e.g. surface 1 or bottom surface 6 which surfaces will not be placed against the person's body. The tubes should be sufficiently recessed from the person support surface 5 so that no undesirable contact with the person's anatomy at that location occurs. Optimally the tubes are sufficiently distant from each of the surfaces 1, 5 and 6 that any of these surfaces may be used as the surface contacting the person's body.

The cushions 2 comprise two elongated triangular resilient foam members which, in an end view, form triangles. As shown, the triangles are isosceles, however, equilateral or right triangular shapes are also advantageous as is circular, rectangular or oval shapes. Cushions 2 are made preferably of foam rubber which is a foamed synthetic plastic that remains flexible and resilient. Other similar resilient materials may be used. Also, the cushions could be of solid material or an inflatable member, even a fabric member filled with gel or foam.

When the device is placed on, for example, a bed so that it abuts the headboard, a person can place their buttocks, shoulders or head against the cushions (in this embodiment a triangular shaped cushion would be preferable) and recline so that the cushions support their hips and/or other upper body portion of the user with the center portion between the support members providing an area without pressure. Thus, the center portion will prevent pressure from being applied to an incision (with or without a bandage or dressing) or healing area while adjacent areas are supported by the support cushions. Rectangular cushions are useful for providing support for a person leaning back against a bed headboard with the cushions being placed above the hip area and/or below the waist. Cushions of different size are advantageous for support of different body areas. For example, larger cushions 3 are used to support the buttocks and hips whereas smaller cushions 3 would be better for support at the neck area at the shoulders or the base of the skull, as needed.

Figure 4:
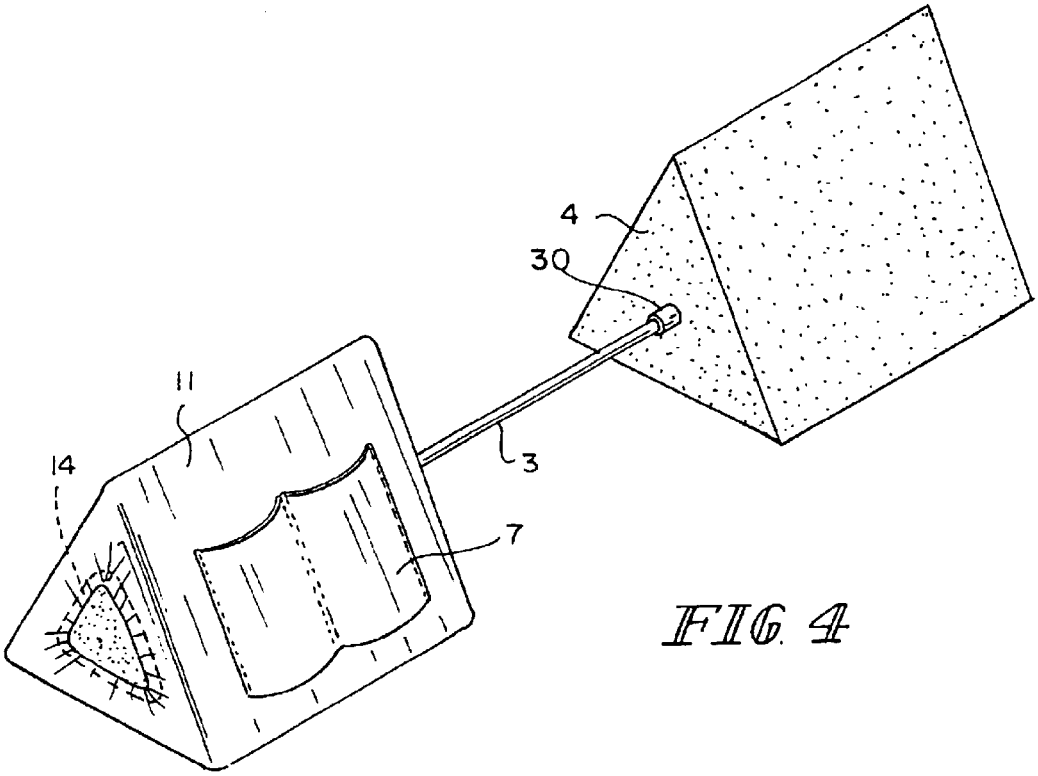
FIG. 4 shows a perspective view of the invention with a releasable connection of the tube and cushion and with pockets in the cushion cover.

Both cushions 2 each have an outer wrapping layer of thin flexible sheeting, or fabric cover 11 (FIG. 4), which extends over at least the front surface 5 of the cushion. The fabric cover 11 may extend completely around the cushion with only the ends, or part of the ends, being exposed. As seen in FIG. 4 cover 11 is held in place by elastic members 14 (only one is shown) at each end which holds the cover 11 in place. Cover 11 is made out of a typically light-weight but strong fabric like nylon, polyester or similar material which can be easily cleaned. Also, the fabric cover 11 may be of flannel or terry-cloth which provides a non-slip surface and is absorbent to remove moisture from the skin. The cover 11 should be washable and provided with zippers, elastic or other means for facilitating easy removal and mounting to each cushion 2.

As shown in FIG. 4 fabric cover 11 may also include pockets 7 which may be filled with heating or cooling means (not shown) like a hot/cold gel pack or thermal pack such as is described in U.S. Pat. No. 4,756,311. Other types of heating or cooling means include ice packs, resistance heating means, etc. The pockets and packs may vary in shape, size and number. The insert material is flexible and conforms to the shape of a person's torso. Of course the covers, pockets and/or cushions could be further modified to incorporate vibration and/or magnetic therapy.

The adjustable spacer tubes 3 may be telescoping members (described with respect to FIG. 2) constructed from small diameter aluminum tubing which affords some resiliency in a direction perpendicular to their length, but otherwise remains essentially rigid. By rigid telescoping members it is meant that once the desired spacing is set the spacer tubes 3 are rigid in either longitudinal direction 16 (see FIG. 5) so as to not permit the cushions to move longitudinally, e.g., spread apart when the person leans against them.

Figure 2:
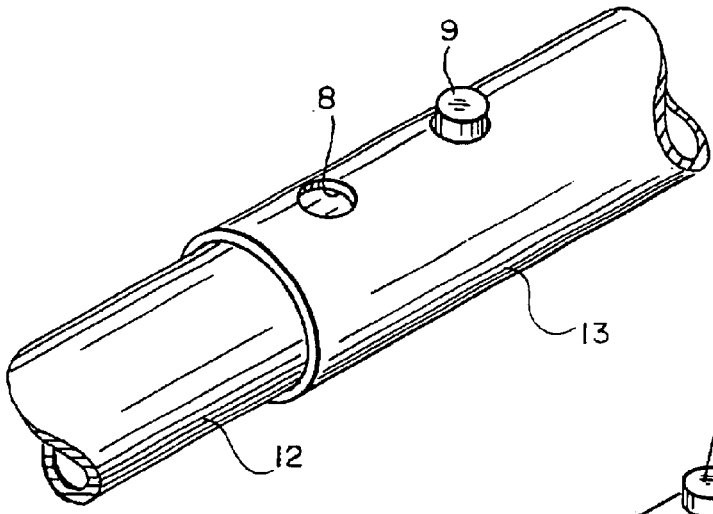
FIG. 2 shows a perspective view of an embodiment of the adjustable joining tubes of the invention.
Figure 3:
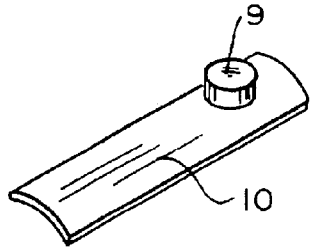
FIG. 3 shows the spring arm and pin of FIG. 2.

As seen in FIG. 2 at least one of the telescoping portions of tubes 3 are provided with an adjustment like the pin and hole arrangement shown. The tubing segments 12, 13 have a series of spaced holes 8 sized to receive a spring-biased pin 9 projecting from the distal end of a spring arm 10 (FIG. 3). The other end of the spring 10 is fixed to the interior of the smaller tubing segment. The pin 9 extends from an end of the spring arm 10 through a hole 8 in the smaller tube and may be depressed against the spring so that the end of the pin 9 retracts into the hole in the smaller tube when it is desired to slide the tubes with respect to each other so as to selectively engage the pin 9 with any of the holes 8 in the larger tube. Only two holes 8 are shown in FIG. 2 with the pin 9 extending through aligned holes in tube segments 12 and 13. Additional holes are contemplated in segment 13, the greater the number of holes the greater the adjustability. Other similar adjustable arrangements may be used to secure the cushions in place and allow their spacing to be varied as desired. For example, it is known to provide a threaded member on the end of the larger telescoping tube which can crimp the outer tube against the inner tube to firmly hold the tubes in interference type engagement. In the embodiment shown in FIG. 1 the ends of tubes 3 extending into the cushions may be fixed thereto as by molding or bonding.

Only one of the tubes 3 in FIG. 1 need be a rigid tube. While all three may be made be made rigid via adjustment means like the described spring and pin arrangement, only one need be rigid after completing the adjustment. At least one of the other tubes 3 can be just a rod or tube member that slides in and out of a hole through one or both cushions 2. Such member does not become rigid in the elongated direction 16, but it does provide some torsional support.

As seen in FIG. 4 the cushions each are molded or otherwise formed around a tube 30 which slightly protrudes from the end face 4 and has a single hole 8 (not shown) for connection to tube 3 via a spring 10 and pin 9. Of course tube 30 may protrude from both end faces 4 to enable attachment to either end. Each tube 3 fits into a tube 30 in a cushion with a suitable fastener, like the hole 8 and spring-biased pin 9 so that each tube 3 is releasably attached to a tube 30 whereby the parts can be disconnected and conveniently stored or shipped. In the embodiment of FIG. 4 tubes 3 may be adjustable segments like segments 12 and 13. Alternatively, a single tube length 3 with several spring 10 and pin 9 connectors arranged along its length may be provided to permit the desired adjustability.

Figure 5:
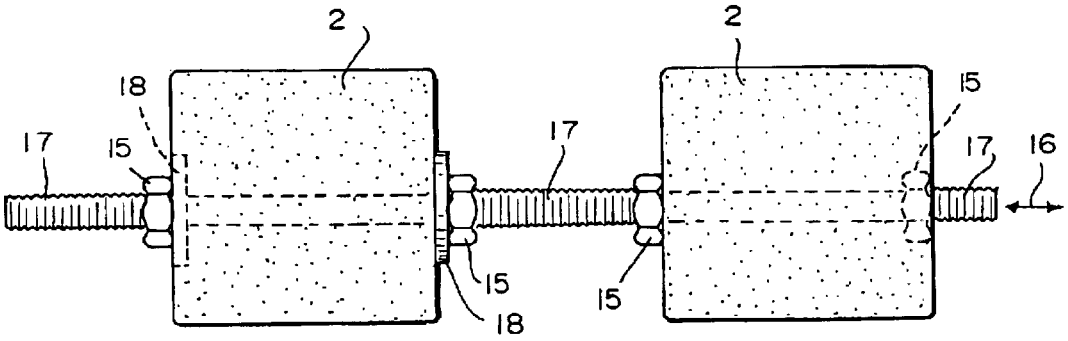
FIG. 5 shows a plan view of the invention with a screw type adjustable connector.

Another embodiment of the invention is shown in FIG. 5 wherein the cushions 2 are connected by a screw type connector 17 (a rod with a screw thread on its outside surface). Each of the cushions 2 has a nut 15 affixed to one or both ends of the cushion so that the rod 17 with a screw thread can be threaded into the nuts 5. Four nuts are shown in FIG. 4 and nuts at the ends of each cushion 2 are preferred, but the invention may be accomplished with only one nut 5 on an end of each cushion. As seen in FIG. 5 the nut 15 may be inside the cushion (the far right-hand nut), outside the cushion and not fixed to the cushion (the next to the far right-hand nut), outside the cushion with a washer 18 either bonded to, or not bonded to, the cushion (the next to the left-hand nut) and with a one piece nut 15 and washer 18 with at least the washer fixedly attached inside the cushion (the next to the left-hand nut). The cushions have an elongated space between the nuts 5 for accommodating the screw type connector 17. All one has to do to adjust the spacing is to spin one of the cushions 3 and/or nuts 15 about their axis 16 and the rotating cushion and/or nut will move along the threaded rod 3. By rotating one or both cushions and/or nuts the spacing will be adjusted between them. Alternatively, the rod could be rotated about its axis while holding one of the cushions and/or nuts and letting the other cushions and/or nuts not rotate.

Figure 6:
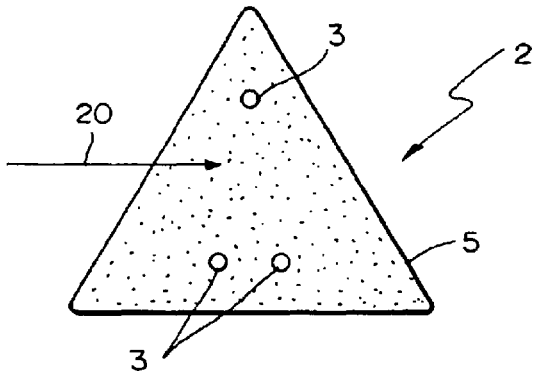
FIG. 6 shows a end view of one of the cushions.

FIG. 6 shows an end view of one of the cushions 2 with three tubes 3 shown in spaced relation such that a person's hand can move in the direction of arrow 20 between the tubes 3 and could cleanse or massage a person's back resting against surface 5. The space between the tubes 3 also permits insertion, or withdrawal, of a hot or cold pack or other medical device. The arrangement of FIG. 6 is for the purpose of illustration only, obviously other arrangements of the tubes 3 are contemplated.

Figure 7:
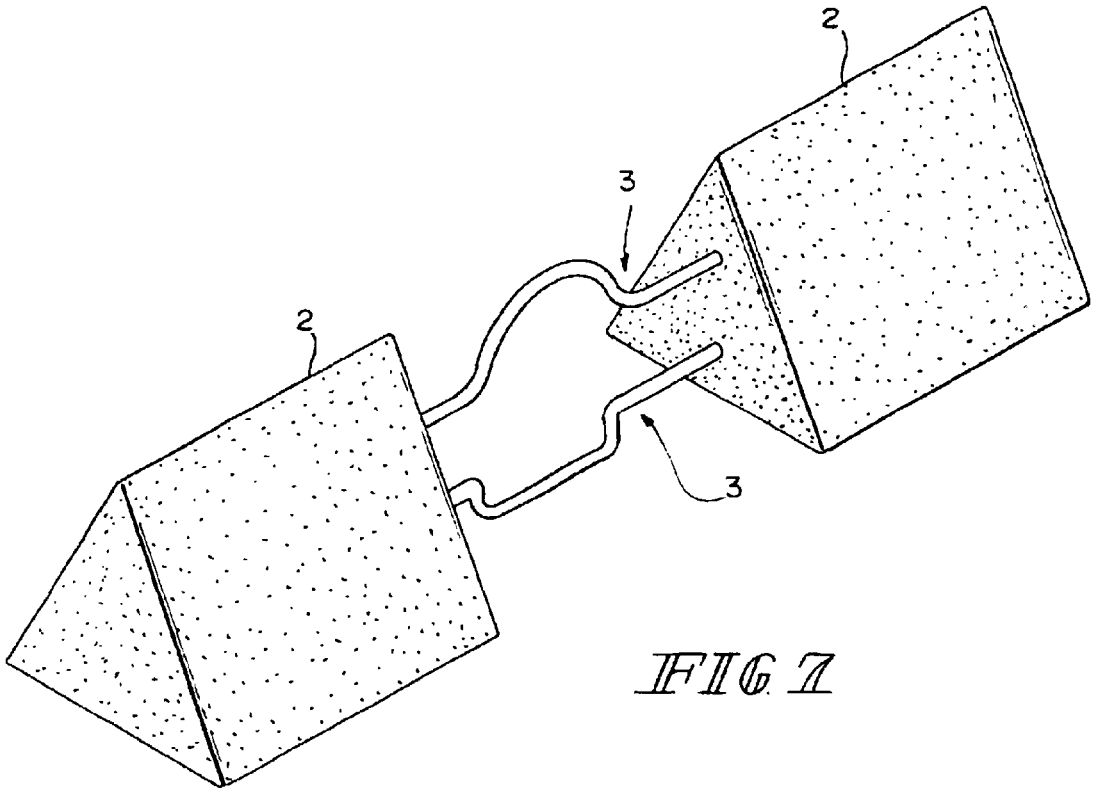
FIG. 7 shows a perspective view of another embodiment of the adjustable joining tubes and cushions of the invention.

FIG. 7 illustrates another embodiment like FIG. 6 wherein a person's hand can move between the tubes 3 to reach the area of the person's back, e.g., when the person is asleep or cannot be moved. FIG. 7 differs from FIG. 6 in that in FIG. 7 the tubes 3 are bent to provide an opening sufficient to enable one or more hands and forearms to reach the back/support area. Again, while the bend in one tube is shown in the form of a semi-circle and the other is somewhat rectangular, other shapes allowing entry are contemplated. The tubes 3 in FIGS. 6 and 7 may of course be made adjustable using the pin 9 and hole 8 arrangement discussed above, or another adjustable arrangement.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An adjustable body support device for applying supportive pressure to spaced areas of a human torso comprising, spaced apart first and second bodies of resilient compressible material, and at least one adjustable member extending between central portions of the first and second bodies for adjustably and rigidly maintaining the end to end spacing between the first and second elongated bodies to allow the support device to support a human torso at two spaced locations and to provide a non-contact area for the human torso.

2. The device of claim 1 wherein the at least one adjustable member is a rigid telescoping member.

3. The device of claim 2 further comprising at least one sliding non-rigid member connecting the first and second bodies.

4. The device of claim 2 wherein the at least one adjustable member comprises telescoping tube segment.

5. The device of claim 4 wherein the telescoping tube segments have a spring member with one end of the spring attached to the inside of the smaller diameter segment so that a pin on the distal end of the spring protrudes through aligned holes in the telescoping segments to lock them together.

6. The device of claim 1 wherein each of the bodies is formed about and adhered to an adjustable member.

7. The device of claim 6 wherein at least one of the bodies is formed about a tube which protrudes from an end face of one of the bodies and wherein the tube is adapted for releasably attaching to the at least one adjustable member.

8. The device of claim 7 wherein the at least one of the bodies is formed about the tube by molding.

9. The device of claim 1 wherein at least one body has a triangular cross-section.

10. The device of claim 9 wherein the triangular cross-section is a right triangle cross-section.

11. The device of claim 1 wherein at least one body has a circular cross-section.

12. The device of claim 1 wherein the first and second bodies each have a triangular cross-sectional shape and wherein the bodies are joined with the adjustable member intersecting each body proximate the central portion of an end face and not near an edge of the end face.

13. The device of claim 1 wherein the first and second bodies are joined with one or more adjustable members intersecting each body proximate the central portion of an end face and so that no adjustable member underlies a body support surface.

14. The device of claim 1 wherein the at least one adjustable member is a screw extending between the first and second bodies and with at least one nut proximate the end face of at least one of the bodies.

15. The device of claim 14 further comprising at least one sliding non-rigid member connecting the first and second bodies. telescoping tube segments have a spring member with one end of the spring attached to the inside of the smaller diameter segment so that a pin on the distal end of the spring protrudes through aligned holes in the telescoping segments to lock them together.

16. The device of claim 1 further comprising a removable cover member for covering at least one of the bodies of resilient compressible material.

17. The device of claim 16 wherein the cover member has one or more pockets for holding hot or cold packs.

18. The device of claim 1 wherein at least one of the bodies is made from foam rubber.

19. The device of claim 1 wherein at least one of the bodies is an inflatable member.

20. The device of claim 1 wherein at least one of the bodies is an elongated member.

21. An adjustable body support device for applying supportive pressure to spaced areas of a human torso comprising, first and second elongated bodies of resilient compressible material, each elongated body being shaped to be placed in spaced end to end fashion with each other for providing support for a human torso, and a plurality of adjustable telescoping members extending between central portions of the first and second bodies for rigidly adjustably maintaining the end to end spacing between the first and second elongated bodies.

22. An adjustable body support device for applying supportive pressure to spaced areas of a human torso comprising, first and second elongated bodies of resilient compressible material, each elongated body being configured to have at least one end placed in spaced end to end fashion with one other for providing support for a human torso, a first tube protruding from at least one end face of at least one of the first and second elongated bodies and being shaped for adjustably connecting to a second tube, and the second tube being connected to the other body and in adjustable telescoping relation to the first tube and extending between central portions of the first and second elongated bodies for adjustably maintaining an end to end spacing between the first and second elongated bodies.

* * * * *